US012677948B2

(12) United States Patent
Clement

(10) Patent No.: US 12,677,948 B2
(45) Date of Patent: Jul. 14, 2026

(54) ADJUSTABLE CABINET LEG

(71) Applicant: Samuel Clement, Albany, NY (US)

(72) Inventor: Samuel Clement, Albany, NY (US)

( * ) Notice: Subject to any disclaimer, the term of this patent is extended or adjusted under 35 U.S.C. 154(b) by 71 days.

(21) Appl. No.: 18/817,763

(22) Filed: Aug. 28, 2024

(65) Prior Publication Data

US 2026/0060419 A1 Mar. 5, 2026

(51) Int. Cl.
*A47B 91/02* (2006.01)

(52) U.S. Cl.
CPC ..... *A47B 91/024* (2013.01)

(58) Field of Classification Search
CPC ..... A47B 91/00; A47B 91/02; A47B 91/024
USPC ..... 312/351.1, 351.3; D6/710; 248/188.2, 248/188.4, 188.8; 403/408.1, 409.1
See application file for complete search history.

(56) References Cited

U.S. PATENT DOCUMENTS 2,738,246 A * 3/1956 Hogan, Jr. ..... F16B 12/52 248/188.8
2,823,392 A * 2/1958 Howard ..... F16B 12/52 5/310
2,826,470 A * 3/1958 Denton ..... A47B 13/021 248/188.8
2,836,925 A * 6/1958 Friedman ..... A47B 91/00 248/188.4
2,842,417 A * 7/1958 Scanlon ..... A47B 91/00 248/188.8
3,104,493 A * 9/1963 Nalle ..... A47B 91/028 248/188.4
3,516,633 A * 6/1970 Blackwood ..... A47B 13/021 248/188
4,042,199 A * 8/1977 Winkler ..... A47B 91/00 5/310
5,511,760 A 4/1996 Kambara
5,791,612 A * 8/1998 King ..... A47C 3/38 248/188.4
7,286,369 B2 * 10/2007 Yaor ..... A47B 91/00 361/801
7,588,386 B2 9/2009 Kielczewski et al.
7,780,128 B2 8/2010 Walsberg
D793,786 S * 8/2017 Rawls-Meehan ..... D6/709
11,071,382 B2 7/2021 Cole
11,723,463 B2 8/2023 Pizzi et al.
12,007,066 B2 * 6/2024 Burnett ..... A47B 13/02
2002/0174620 A1 * 11/2002 Binnebose ..... F16B 9/054 248/188
2006/0016949 A1 * 1/2006 Payne ..... A47B 91/00 248/346.01

(Continued)

FOREIGN PATENT DOCUMENTS

CN 209677857 U 11/2019
CN 218869808 U 4/2023

(Continued)

*Primary Examiner* — James O Hansen
(74) *Attorney, Agent, or Firm* — Simpson & Simpson, PLLC

(57) ABSTRACT

An adjustable cabinet leg having a body, which body is generally frustoconical in shape, the body also having an annular top surface, an adhesive pad affixed to the annular top surface, a raised annular protrusion extending upwardly from the top surface, and a set screw operatively arranged to adjust the height of a cabinet to which the cabinet leg is attached.

13 Claims, 7 Drawing Sheets

(56) References Cited

U.S. PATENT DOCUMENTS

| | | | | |
|---|---|---|---|---|
| 2011/0187247 | A1* | 8/2011 | Carter | A47B 46/00 312/246 |
| 2013/0075549 | A1 | 3/2013 | Huang | |
| 2024/0369089 | A1* | 11/2024 | Black | F16B 12/52 |

FOREIGN PATENT DOCUMENTS

| | | | | |
|---|---|---|---|---|
| DE | 1895770 | U | 7/1964 | |
| DE | 20 2011051681 | * | 3/2013 | A47B 91/02 |
| EP | 3996550 | A1 | 5/2022 | |
| JP | 4042465 | B2 | 2/2008 | |
| KR | 101436343 | B1 | 9/2014 | |
| KR | 101702597 | B1 | 2/2017 | |
| KR | 200145432 | A | 12/2020 | |
| KR | 102569839 | B1 | 8/2023 | |

* cited by examiner

ADJUSTABLE CABINET LEG

FIELD OF THE INVENTION

The present invention relates generally to an adjustable cabinet leg and method of levelling a cabinet using the adjustable cabinet leg. In particular, embodiments relate to a cabinet leg that is adjustable through the top surface of a cabinet floor.

BACKGROUND OF THE INVENTION

When installing cabinetry, one critical and often time-consuming step in the process is ensuring that all of the cabinets within a room are level. Cabinets that are not level can introduce a multitude of problems during subsequent phases of construction, as well as problems with the finished appearance and functionality of the cabinetry itself. For example, a function of cabinets, particularly kitchen cabinets, are to serve as a base for a countertop. If the cabinets which support a countertop are not level, the countertop will not fit properly when installed upon the cabinets. This can lead to the countertop cracking or deforming over time. The proper leveling of cabinets also ensures that the drawers and doors of the cabinets can function properly. Further, cabinets that are not level may also create unwanted gaps, allowing for food or other debris to accumulate over time, creating unsightly and potentially unsafe conditions. Another reason it is important to ensure that cabinets are level is aesthetics. A cabinet that is not level can look unfinished and unprofessional.

There are several different methods cabinet installers can employ to level a cabinet during installation, the most common being through the use of wooden shims. Less common methods include the use of leveling assemblies or adjustable legs as described below. A wooden shim for leveling a cabinet is generally a tapered wedge shape, which is used to fill the space between the floor or wall and the cabinet created when a cabinet is not level. The problem with using wooden shims to level a cabinet is that the process involves a time-consuming trial and error method of measuring and cutting the correctly sized shim to place beneath or behind the cabinet, then checking to make sure the cabinet is level once the shim is in place. If the cabinet is not level, a different or additional shim must be used, and the process of determining if the cabinet is level will have to be repeated. This repetition of measuring and cutting shims until the correct shims are in place, and then making sure the cabinet is level, can be very time-consuming, costing cabinet installers time and money. Further, cabinets that are in corners, or against appliances such as a fridge or range (stove), can be difficult to level through the use of shims due to the decreased amount of space where shims can be placed. Various attempts to solve these problems have been contemplated and employed.

For example, U.S. Pat. No. 11,071,382 discloses an adjustable leg for supporting a cabinet comprising a head plate, an upper shaft section, a lower shaft section, and a foot. The head plate can be integral with the upper part of the upper shaft section or can be a separate part which accepts the upper shaft as a push-in component. Further, the head plate can be screwed or knocked-in with an expandable dowel feature to a base of a cabinet through holes so that the upper shaft section of the adjustable leg extends downward from the base of the cabinet into a void. The upper shaft section and the lower shaft section are threaded together so that when one is rotated relative to the other, the distance between the foot and the head plate changes. An installer can rotate each of the feet as necessary so as to alter the length of each leg and thereby arrange for the cabinet to be supported on the floor by means of the legs, with the cabinet base in a horizontal attitude.

Another example is shown in U.S. Pat. No. 7,780,128, which discloses a system for leveling relative to a basis surface. The system includes a device assembly comprising a pair of couplers and a threaded rod. Each coupler is a threaded fitting configured to threadably engage the rod to fasten or couple the rod and the bottom of a shelf. The rod is positioned upright in a hole formed in the bottom of the shelf such that a lower portion of the rod extends downward beneath the shelf, and an upper portion extends upward above the shelf. The coupler that is disposed on the upper portion of the rod engages an upper surface of the shelf and the coupler that is disposed on the lower portion of the rod engages a lower surface of the shelf, thereby pinching the shelf between the pair of couplers, securing the rod in an upright, or vertical, position and maintaining a fixed rotational position of the couplers.

Therefore, there is a long-felt need for an adjustable cabinet leg that can be installed and adjusted quickly, with minimal tools and effort, within the cabinet floor itself. Further, an adjustable cabinet leg which can be adjusted through the floor of the cabinet allows for a less time-consuming process of leveling and allows cabinets of different sizes and positions within a room to be leveled without the use of shims.

SUMMARY

An adjustable cabinet leg having a body having a generally frustoconical outer surface, the body having a longitudinal axis, the body further having a partially threaded through-bore arranged along the axis, the body having an annular bottom surface having an inside diameter and an outside diameter and an annular top surface having an inside diameter and an outside diameter, wherein the threads of the partially threaded through-bore are located proximate the annular bottom surface, an adhesive pad affixed to the annular top surface, the adhesive pad having a release liner, a raised annular protrusion having an inside diameter and an outside diameter extending upwardly from the top surface, the inside diameter of the annular protrusion arranged concentrically about the annular top surface inside diameter, and a set screw having a drive, a tip and a threaded shank arranged to engage the threads of the partially threaded through-bore, the set screw having a socket within the shank proximate the drive, the set screw further having a semi-spherical end cap having an outer surface, the end cap further having an annular top surface having an inside diameter and an outside diameter, the inside diameter of the end cap annular top surface circumscribes the shank of the set screw proximate the tip, the outside diameter of the end cap annular top surface is substantially equal to the outside diameter of the annular bottom surface of the body, the end cap being made of a different material than the set screw, the end cap secured to the tip of the set screw.

In some embodiments, the present invention comprises the aforementioned adjustable cabinet leg, wherein the outer surface of the body has a first color, and the outer surface of the end cap has a second color.

In some embodiments, the first color is identical to the second color, and in other embodiments, the first color is of a first hue and the second color is of a second hue, wherein the first hue is different than the second hue.

In some embodiments, the present invention comprises the aforementioned adjustable cabinet leg, wherein the generally frustoconical outer surface comprises a lower frustoconical outer surface and an upper cylindrical outer surface.

In some embodiments, the present invention comprises the aforementioned adjustable cabinet leg, wherein the socket is a hex socket.

In some embodiments, the present invention comprises the aforementioned adjustable cabinet leg further comprising a surface cap removably secured to the raised annular protrusion of the adjustable cabinet leg.

In some embodiments, the present invention comprises an adjustable cabinet leg kit, the kit having the aforementioned adjustable cabinet leg, and a drilling jig having a substantially annular body having an outer diameter and an inner diameter forming an inner aperture.

In some embodiments, the present invention comprises the aforementioned adjustable cabinet leg kit, wherein the drilling jig further comprises a raised annular protrusion circumscribing the inner aperture.

In some embodiments, the present invention comprises the aforementioned adjustable cabinet leg kit, wherein the drilling jig further comprises a raised annular protrusion circumscribing the inner aperture and a bushing arranged within the inner aperture.

In some embodiments, the present invention comprises the aforementioned adjustable cabinet leg kit further comprising a surface cap.

The present invention also comprises a method for leveling a cabinet using the aforementioned adjustable cabinet leg, the method comprising drilling a plurality of holes in the cabinet floor, peeling away the release liner of the adjustable cabinet leg, securing at least three adjustable cabinet legs to the cabinet floor by inserting the raised annular protrusion of each leg inside of each of the plurality of holes in the cabinet floor, and adjusting each adjustable cabinet leg with a tool inserted into each socket to level the cabinet.

A general object of the present invention is to provide an adjustable cabinet leg which can be installed quickly with minimal tools and effort within a cabinet floor. By using the adjustable cabinet leg to level a cabinet, cabinet installers can save time and money compared to the standard way of levelling cabinets through the use of wooden shims or through the use of complicated leveling systems.

Another object of the present invention is to allow the adjustable cabinet leg to be adjusted through the floor of the cabinet itself. This further decreases the amount of time it takes to level the cabinet by eliminating the need to lift the cabinet and add wooden shims beneath the cabinet, a process that potentially involves several repetitions before levelling is complete.

A further object of the present invention is to allow cabinets of different sizes and in different positions to be quickly leveled. When a cabinet is of an irregular size, the use of wooden shims becomes difficult and time consuming. Further, when a cabinet is placed against an appliance, such as a fridge or range (stove), it is difficult to use wooden shims due to the lack of area around the outside of the bottom or back of the cabinet where the wooden shims need to be placed.

These and other objects, features, and advantages of the present invention will become readily apparent upon a review of the following detailed description of the invention, in view of the drawings and appended claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1B:
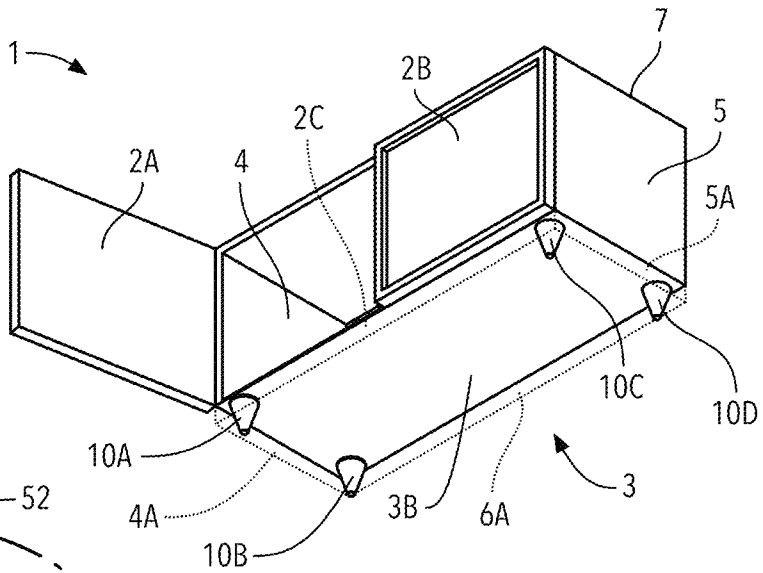
FIG. 1B is a bottom perspective view of cabinet 1 as shown in FIG. 1A.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims. Those in the art will understand that any suitable material, now known, or hereafter developed, may be used in forming the present invention described herein.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be noted that the terms "including," "includes," "having," "has," "contains," and/or "containing," should be interpreted as being substantially synonymous with the terms "comprising" and/or "comprises."

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" or "one of:" is used herein.

Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Figure 1A:
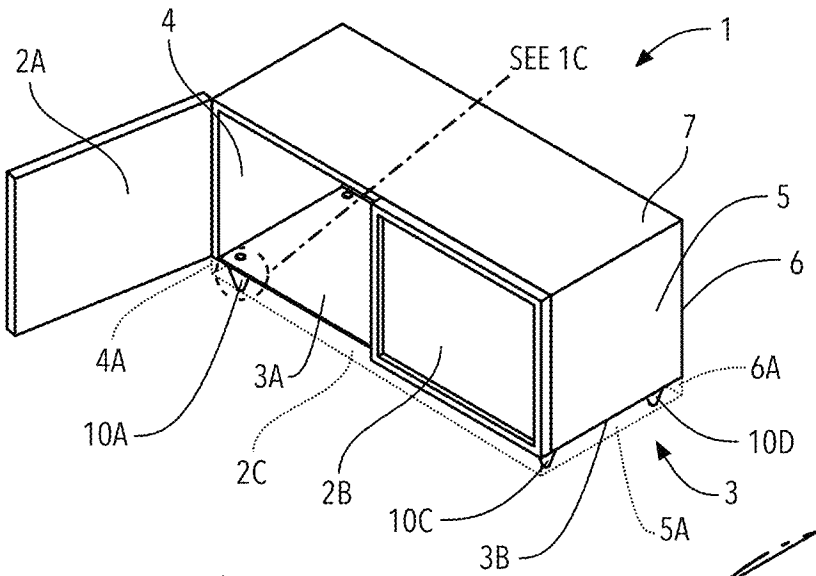
FIG. 1A is a top perspective view of cabinet 1 having a preferred embodiment of the present invention installed in cabinet floor 3.

Adverting now to the figures, FIG. 1A is a top perspective view of cabinet 1 having a preferred embodiment of the present invention installed in cabinet floor 3. Cabinet 1 includes door 2A and door 2B, cabinet floor 3 having top surface 3A and bottom surface 3B, first side panel 4, second side panel 5, back panel 6, and top panel 7. First adjustable cabinet leg 10A, second adjustable cabinet leg 10B (shown in FIG. 1B), third adjustable cabinet leg 10C, and fourth adjustable cabinet leg 10D are installed within cabinet floor 3 at each corner of cabinet 1. Cabinet 1 further includes front toe kick 2C, first side toe kick 4A, second side toe kick 5A, and back toe kick 6A, each represented by hidden lines to reveal cabinet legs 10A, 10B, 10C, and 10D.

FIG. 1B is a bottom perspective view of cabinet 1 shown in FIG. 1A. Cabinet 1 includes door 2A and door 2B, cabinet floor 3 having top surface 3A (shown in FIG. 1A) and bottom surface 3B, first side panel 4, second side panel 5, and top panel 7. First adjustable cabinet leg 10A, second adjustable cabinet leg 10B, third adjustable cabinet leg 10C, and fourth adjustable cabinet leg 10D are installed within cabinet floor 3 at each corner of cabinet 1. Cabinet 1 further includes front toe kick 2C, first side toe kick 4A, second side toe kick 5A, and back toe kick 6A, each represented by hidden lines to reveal cabinet legs 10A, 10B, 10C, and 10D.

Figure 1C:
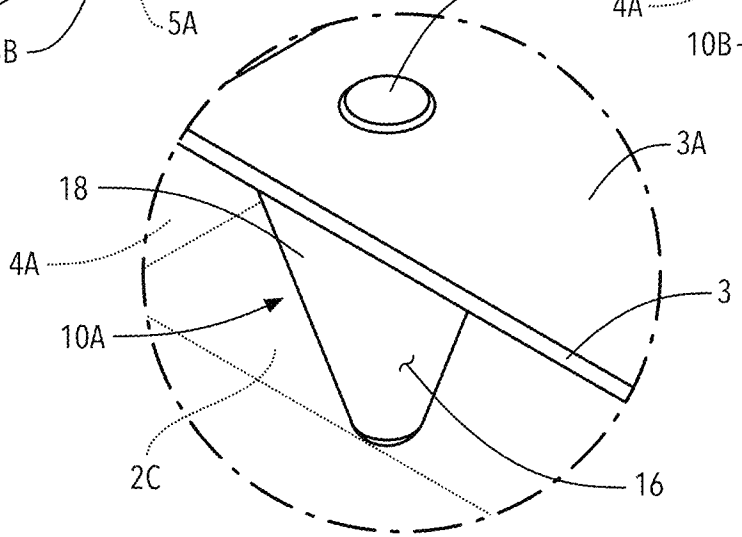
FIG. 1C is a detailed view of the present invention taken generally at detail 1C shown in FIG. 1A.

FIG. 1C is a detailed view of the present invention taken generally at detail 1C shown in FIG. 1A. Surface cap 52 is visible upon top surface 3A of cabinet floor 3. First adjustable cabinet leg 10A is installed through cabinet floor 3 and comprises body 18 having frustoconical outer surface 16. Front toe kick 2C and first side toe kick 4A are represented by hidden lines to reveal first adjustable cabinet leg 10A.

Figure 2:
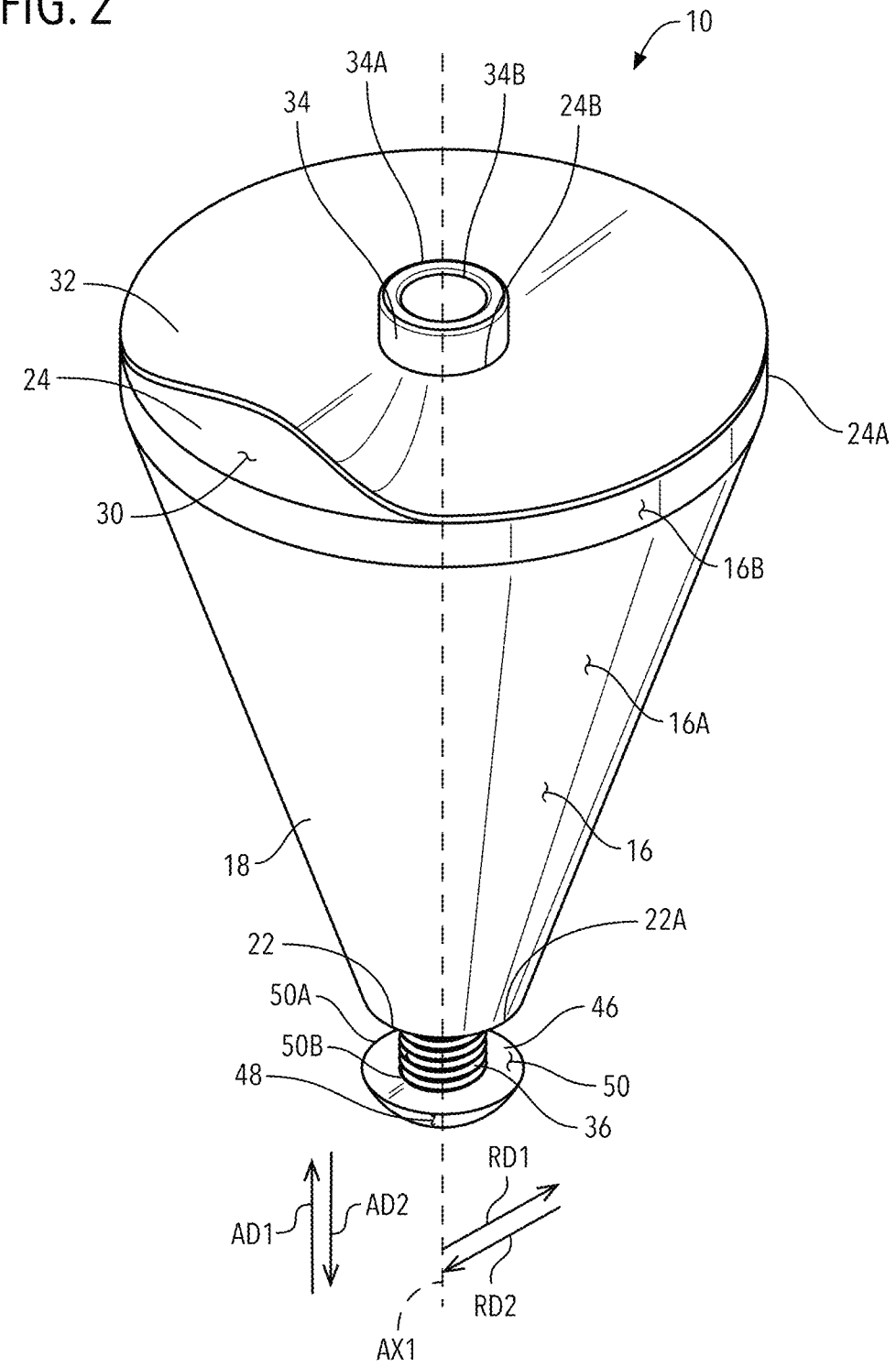
FIG. 2 is a top perspective view of a preferred embodiment of the present invention.

FIG. 2 is a top perspective view of a preferred embodiment of the present invention. Adjustable cabinet leg 10 (hereinafter "leg 10") has body 18 having frustoconical outer surface 16. In a preferred embodiment, body 18 has lower frustoconical surface 16A and upper cylindrical outer surface 16B. Leg 10 further comprises annular top surface 24, having outside diameter 24A and inside diameter 24B. Further still, leg 10 comprises raised annular protrusion 34 having outside diameter 34A and inside diameter 34B, inside diameter 34B arranged concentrically about annular top surface inside diameter 24B. Annular protrusion 34 extends upwardly from annular top surface 24. Adhesive pad 30 is affixed to annular top surface 24, and release liner 32 is removably attached to adhesive pad 30. Proximate annular bottom surface 22 is set screw 36 which comprises semi-spherical end cap 46 having outer surface 48 and annular top surface 50. It should be appreciated that end cap 46 is made of a different material than set screw 36. It should further be appreciated that outer surface 16 of body 18 may be of a first color, and end cap 46 outer surface 48 may be of a second color, or alternatively they may be the same color. End cap annular top surface 50 comprises outside diameter 50A and inside diameter 50B. Inside diameter 50B circumscribes shank 42 (shown in FIG. 3) of set screw 36. Outside diameter 50A is substantially equal to outside diameter 22A of annular bottom surface 22. Leg 10 further comprises longitudinal axis AX1. Set screw 36 travels along longitudinal axis AX1 either in axial direction AD1 or axial direction AD2 when adjusted.

Figure 3:
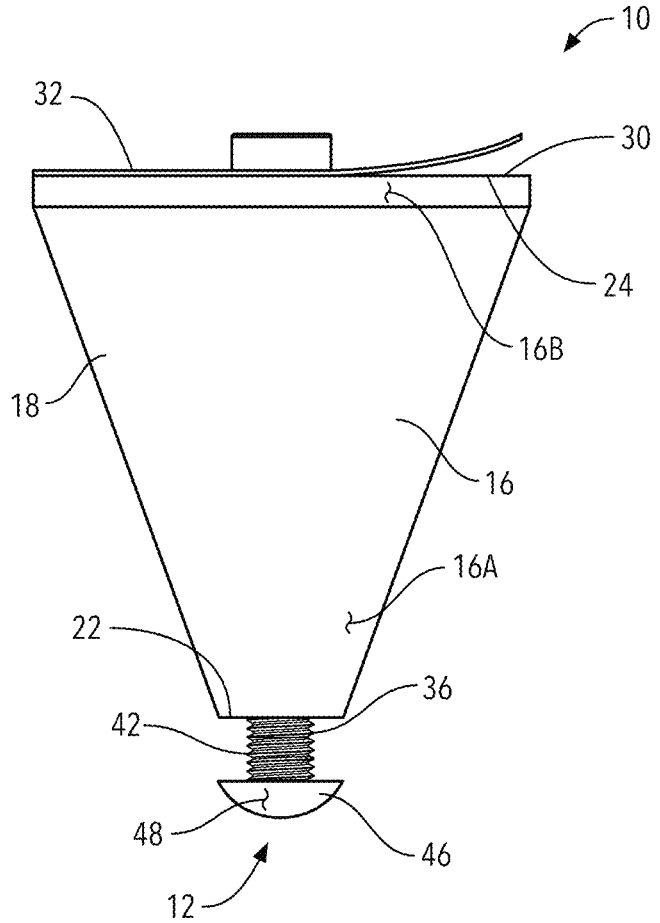
FIG. 3 is a side view of the present invention shown in FIG. 2.

FIG. 3 is a side view of the present invention shown in FIG. 2. Proximate distal end 12 of leg 10, set screw 36 comprises end cap 46 having outer surface 48. Set screw 36 further comprises threaded shank 42. In the preferred embodiment shown in FIG. 3, body 18 has an annular top surface 24 and annular bottom surface 22. Adhesive pad 30 is affixed to annular top surface 24, and release liner 32 is removably attached to adhesive pad 30. Body 18 further comprises frustoconical outer surface 16 having lower frustoconical outer surface 16A and upper cylindrical outer surface 16B.

Figure 4:
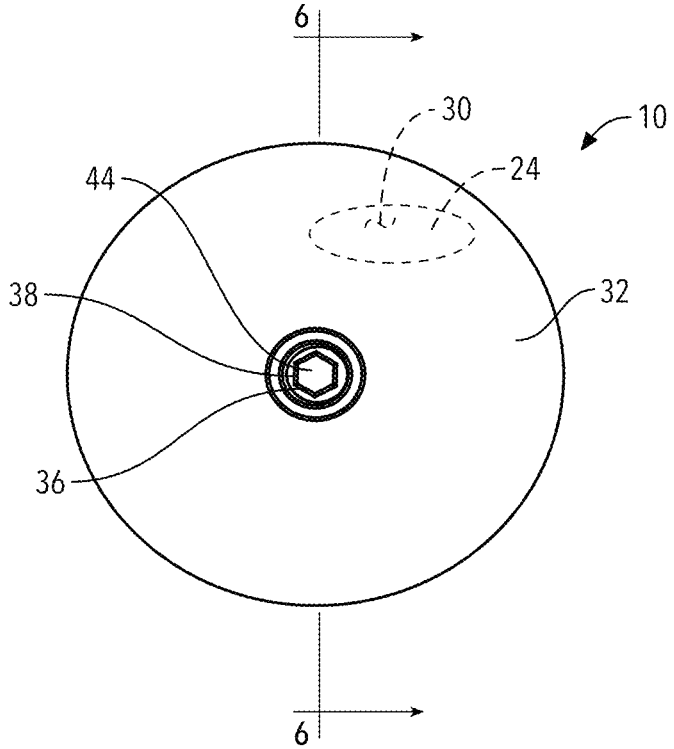
FIG. 4 is a top view of the present invention shown in FIG. 3.

FIG. 4 is a top view of the invention shown in FIG. 2. Leg 10 comprises annular top surface 24 with socket 44 visible. Socket 44 is recessed within set screw 36 proximate drive 38, as detailed in FIG. 6, infra. It should be appreciated that, in a preferred embodiment, socket 44 is a hex socket.

Figure 5:
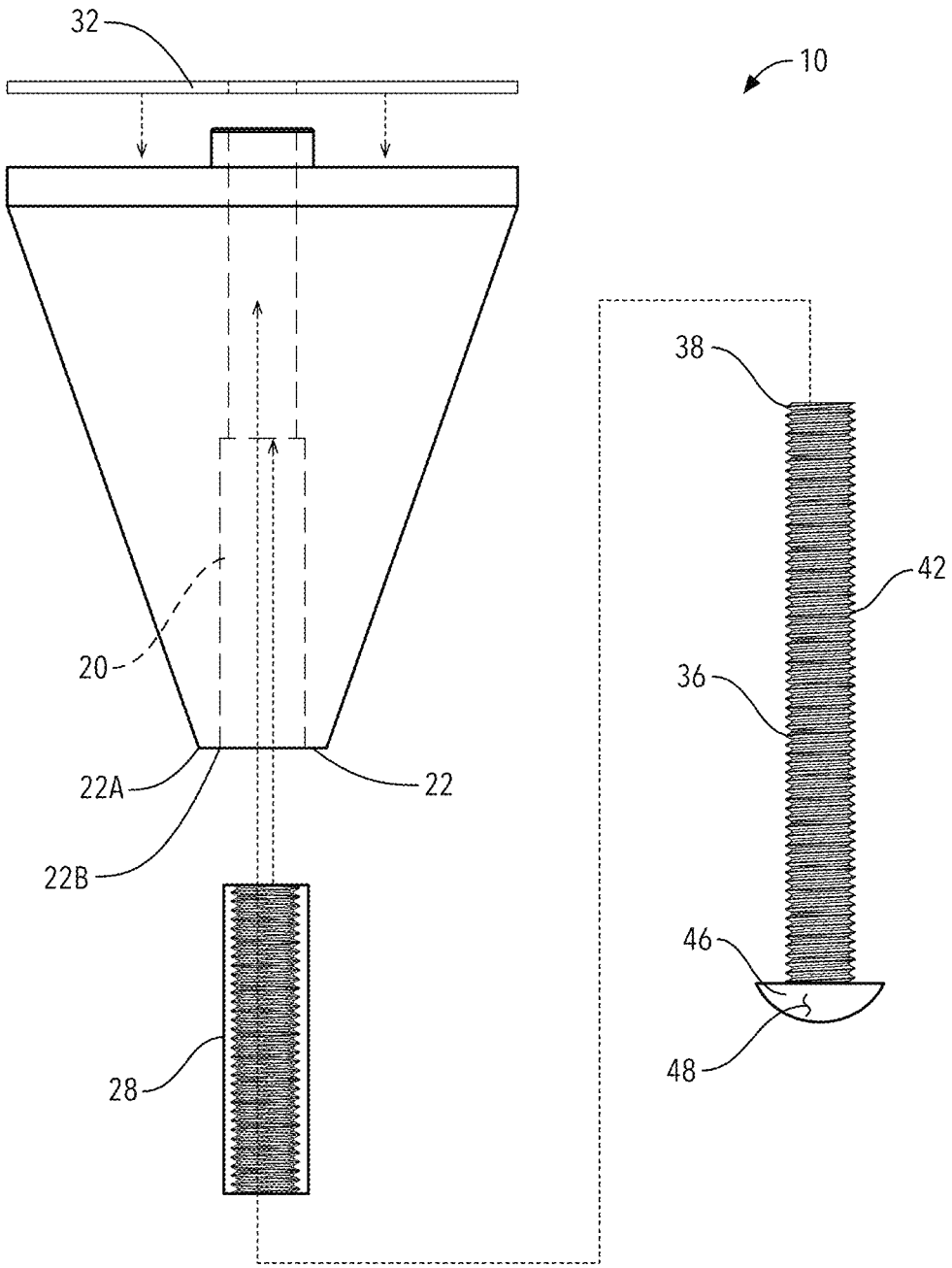
FIG. 5 is an exploded side view of the present invention shown in FIG. 3.

FIG. 5 is a side exploded view of the invention shown in FIG. 3. In the preferred embodiment shown in FIG. 5, leg 10 comprises partially threaded through-bore 20 arranged along longitudinal axis AX1 (shown in FIG. 2). Further, threads, e.g., threaded insert 28, form partially threaded through-bore 20, and threaded insert 28 is arranged proximate annular bottom surface 22. Annular bottom surface 22 has outside diameter 22A and inside diameter 22B. Set screw 36 comprises drive 38, threaded shank 42, and end cap 46 having outer surface 48. Threaded shank 42 of set screw 36 is arranged to engage the threads of partially threaded through-bore 20, more specifically the threads of threaded insert 28.

Figure 6:
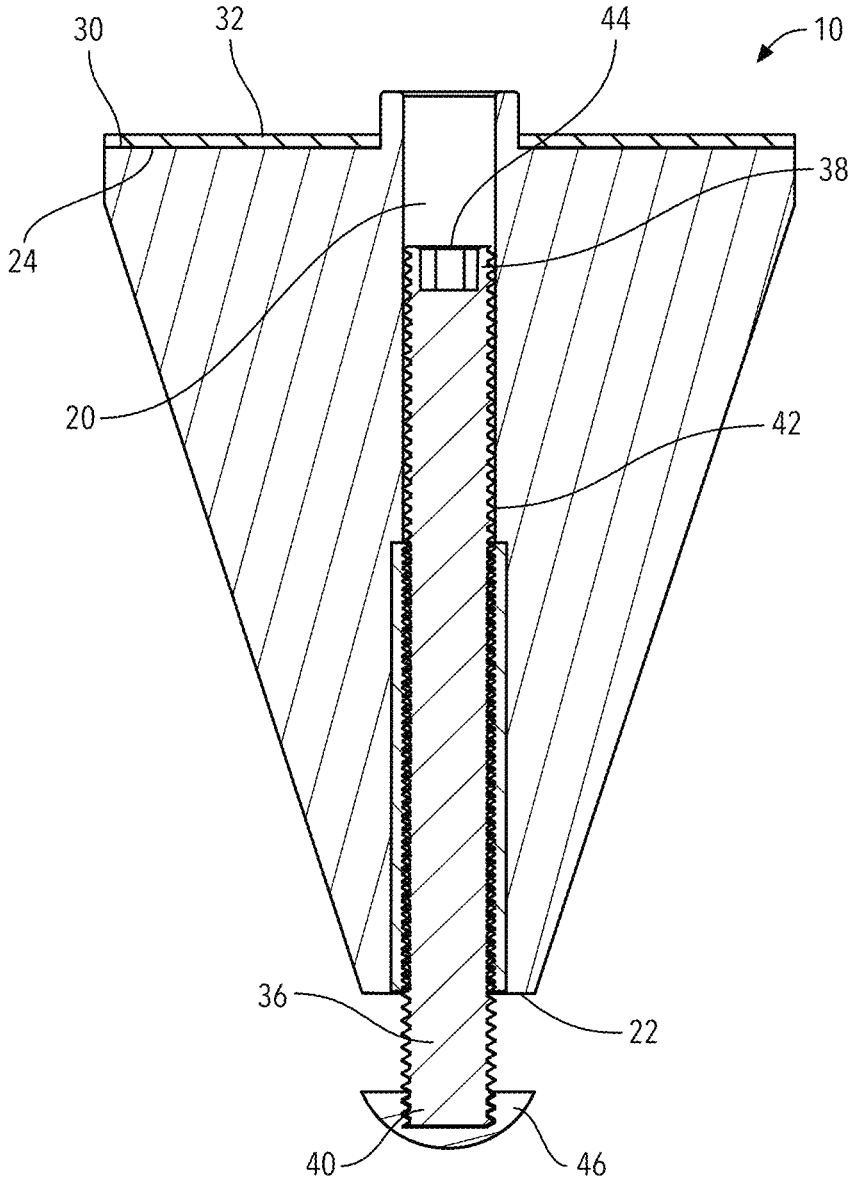
FIG. 6 is a cross-sectional view of the present invention taken generally along line 6-6 shown in FIG. 4.

FIG. 6 is a cross-sectional view of the present invention taken generally along line 6-6 shown in FIG. 4. Leg 10 comprises partially threaded through-bore 20 and set screw 36, set screw 36 having socket 44 proximate drive 38, threaded shank 42, and end cap 46 attached to tip 40 proximate annular bottom surface 22.

The present invention also includes a method for leveling cabinet 1 using leg 10, the method comprising drilling a plurality of holes 66 in cabinet floor 3, peeling away release liner 32 of leg 10, securing at least three legs 10 to cabinet floor 3 by inserting raised annular protrusion 34 of each leg 10 inside of each of the plurality of holes 66 in cabinet floor 3, and adjusting each leg 10 with tool 68 inserted into each socket 44 of each leg 10 to level cabinet 1. The method is further detailed in FIGS. 7A-7D and 8A-8B, infra.

Figure 7B:
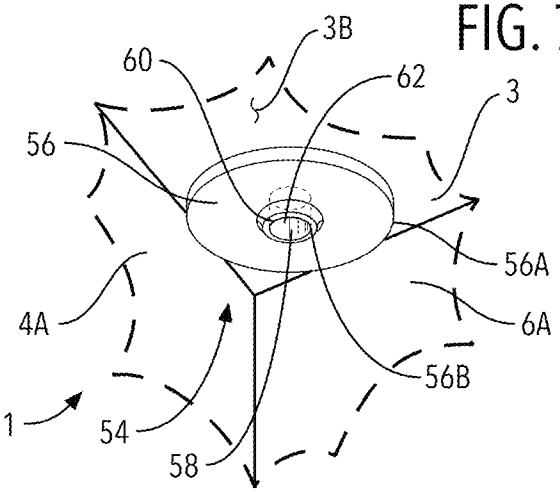
FIG. 7B illustrates the use of drilling jig 54 to begin the method of installing leg 10 of the invention.
Figure 7D:
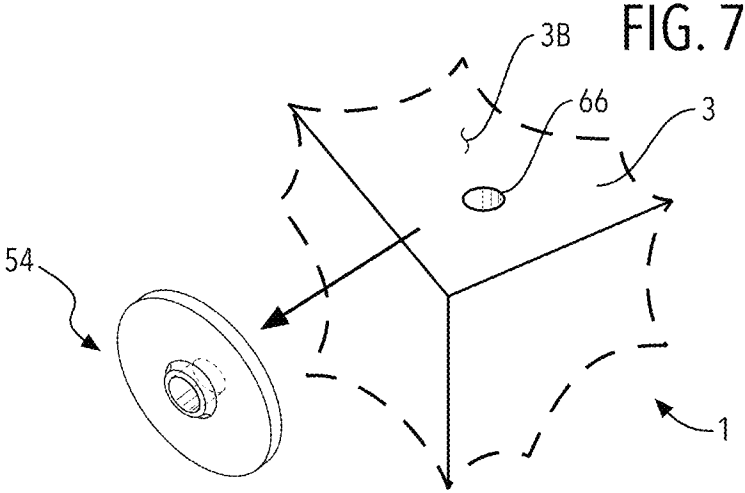
FIG. 7D illustrates removal of drilling jig 54 to reveal hole 66 that has been drilled in floor 3 of cabinet 1 to accommodate installation of leg 10 of the invention.
Figure 7A:
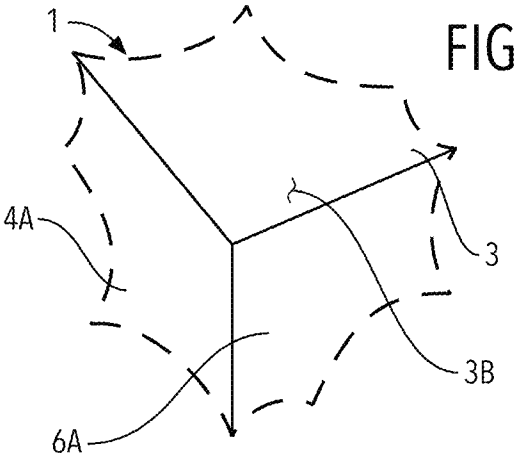
FIG. 7A illustrates a bottom corner of cabinet 1 in which leg 10 of the invention will be installed.

FIG. 7A illustrates a bottom corner of cabinet 1 in which leg 10 of the invention will be installed. Cabinet 1 comprises first side toe kick 4A, back toe kick 6A, and floor 3 having bottom surface 3B.

FIG. 7B illustrates the use drilling jig 54 to begin the method of installing leg 10 of the invention. In a preferred embodiment of the method, drilling jig 54 is placed upon bottom surface 3B of floor 3 and is positioned such that outside diameter 56A of drilling jig 54 is in contact with both first side toe kick 4A and back toe kick 6A. Drilling jig 54 has annular body 56 with outside diameter 56A and inside diameter 56B forming inner aperture 58. Drilling jig 54 further comprises raised annular protrusion 60 circumscribing inner aperture 58. In some embodiments, bushing 62 is arranged within inner aperture 58.

Figure 7C:
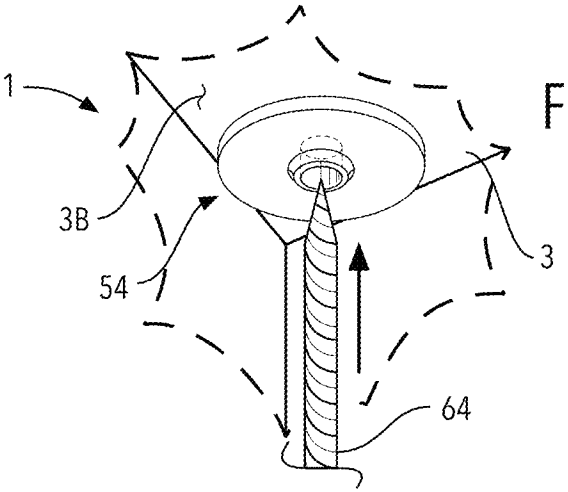
FIG. 7C illustrates drill bit 64 about to be inserted into aperture 58 in drilling jig 54.

FIG. 7C illustrates drill bit 64 about to be inserted into aperture 58 in drilling jig 54 shown in FIG. 7B. Drill bit 64 is drilled through aperture 58 and floor 3.

FIG. 7D illustrates removal of drilling jig 54 to reveal hole 66 that has been drilled in floor 3 of cabinet 1 to accommodate installation of leg 10 of the invention.

Figure 8B:
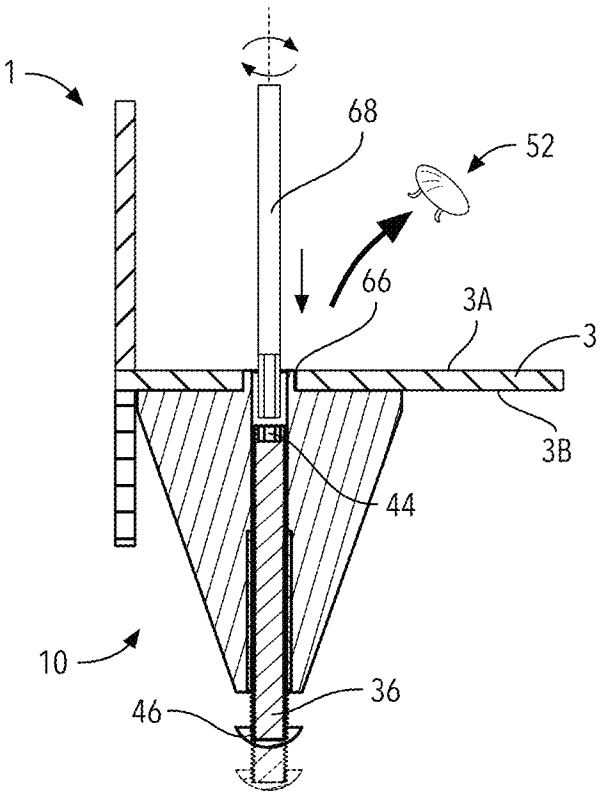
FIG. 8A illustrates alignment and insertion of leg 10 into hole 66 in floor 3 of cabinet 1; and also shows an adhesive press fit to help secure leg 10 to outer bottom surface 3B of cabinet 1; and, FIG. 8B illustrates insertion of adjustment tool 68 into hole 66 in floor 3 of cabinet 1 to adjust the height of set screw 36.
Figure 8A:
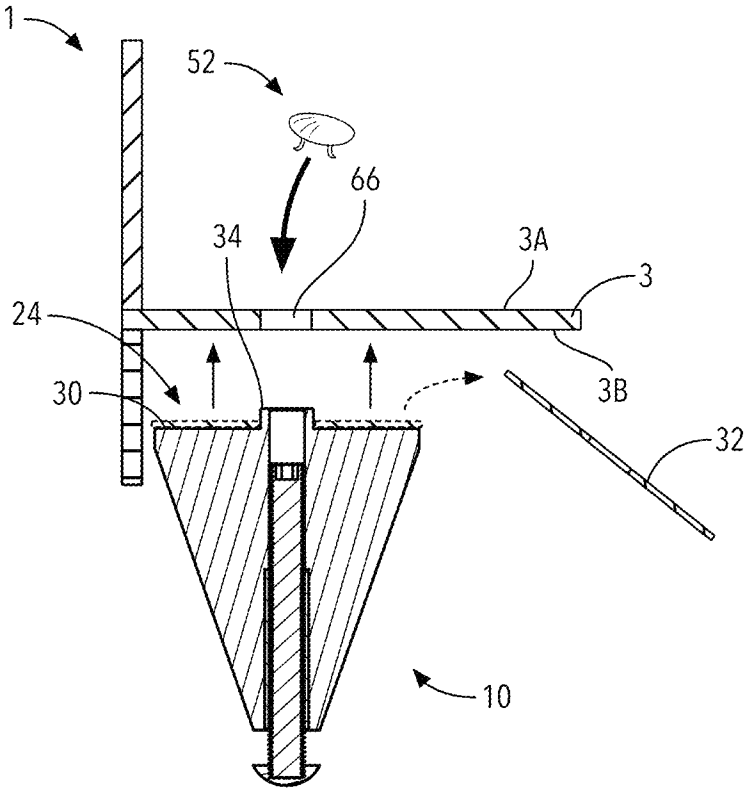

FIG. 8A illustrates alignment and insertion of leg 10 into hole 66 in floor 3 of cabinet 1; and also shows an adhesive press fit to help secure leg 10 to bottom surface 3B of cabinet floor 3. Release liner 32 is removed from adhesive pad 30 to reveal adhesive pad 30. Raised annular protrusion 34 of leg 10 is then inserted within hole 66. In a preferred embodiment, at least three (3) legs 10 are secured to cabinet 1, allowing each leg 10 to be adjusted until cabinet 1 is level. Once cabinet leg 10 is placed inside cabinet floor 3, surface cap 52 is inserted into hole 66. It should be appreciated that surface cap 52 may also comprise a wood plug or sticker with a wood grain design.

FIG. 8B illustrates insertion of adjustment tool 68 into hole 66 in floor 3 of cabinet 1 to adjust the height of set screw 36. Once surface cap 52 is removed, and while leg 10 is secured to bottom surface 3B, tool 68 is placed through hole 66 and into socket 44. By rotating set screw 36, the height of cabinet 1 can be adjusted at each corner until cabinet 1 is level. It should be appreciated that leg 10 may come in a kit comprising leg 10 and drilling jig 54. The kit may also include surface cap 52. The kit may also include tool 68, and in a preferred embodiment, tool 68 is a hex bit having a length that ensures set screw 36 remains in contact with through-bore 20 when tool 68 is fully inserted into through-bore 20.

The embodiments shown and described are merely exemplary and various alternatives, combinations, omissions of specific components, or foreseeable alternative components, understood by one having ordinary skill in the art, described in the present disclosure or within the field of the present disclosure, are intended to fall within the scope of the appending claims.

It will be appreciated that various aspects of the invention and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the claims.

REFERENCE NUMBERS

1 Cabinet
2A Door
2B Door
2C Front toe kick
3 Cabinet floor
3A Cabinet floor top surface
3B Cabinet floor bottom surface
4 First side panel
4A First side toe kick
5 Second side panel
5A Second side toe kick
6 Back panel
6A Back toe kick
7 Top panel
10 Adjustable cabinet leg
10A First adjustable cabinet leg
10B Second adjustable cabinet leg
10C Third adjustable cabinet leg
10D Fourth adjustable cabinet leg
12 Distal end
16 Frustoconical outer surface
16A Lower frustoconical outer surface
16B Upper cylindrical outer surface
18 Body
20 Partially threaded through-bore

22 Annular bottom surface
22A Annular bottom surface outside diameter
22B Annular bottom surface inside diameter
24 Annular top surface
24A Annular top surface outside diameter
24B Annular top surface inside diameter
28 Threaded insert
30 Adhesive pad
32 Release liner
34 Annular protrusion
34A Annular protrusion outside diameter
34B Annular protrusion inside diameter
36 Set screw
38 Drive
40 Tip
42 Threaded shank
44 Socket
46 End cap
48 End cap outer surface
50 End cap annular top surface
50A End cap annular top surface outside diameter
50B End cap annular top surface inside diameter
52 Surface cap
54 Drilling jig
56 Drilling jig annular body
56A Drilling jig annular body outside diameter
56B Drilling jig annular body inside diameter
58 Inner aperture
60 Drilling jig raised annular protrusion
62 Bushing
64 Drill
66 Hole
68 Tool
AX1 Longitudinal Axis
AD1 Axial direction
AD2 Axial direction
RD1 Radial direction
RD2 Radial direction

What is claimed is:

1. An adjustable cabinet leg, comprising:

a body having a generally frustoconical outer surface, said body having a longitudinal axis, said body further having a partially threaded through-bore arranged along said axis, said body having an annular bottom surface having an inside diameter and an outside diameter and an annular top surface having an inside diameter and an outside diameter, wherein said threads of said partially threaded through-bore are located proximate said annular bottom surface;

an adhesive pad affixed to said annular top surface, said adhesive pad having a release liner;

a raised annular protrusion having an inside diameter and an outside diameter extending upwardly from said top surface, said inside diameter of said annular protrusion arranged concentrically about said annular top surface inside diameter; and, a set screw having a drive, a tip and a threaded shank arranged to engage said threads of said partially threaded through-bore, said set screw having a socket within said shank proximate said drive, said set screw further having a semi-spherical end cap having an outer surface, said end cap further having an annular top surface having an inside diameter and an outside diameter, said inside diameter of said end cap annular top surface circumscribes said shank of said set screw proximate said tip, said outside diameter of said end cap annular top surface is substantially equal to said outside diameter of said annular bottom surface of said body, said end cap being made of a different material than said set screw, said end cap secured to said tip of said set screw.

2. The adjustable cabinet leg recited in claim 1, wherein said outer surface of said body has a first color and said outer surface of said end cap has a second color.

3. The adjustable cabinet leg recited in claim 2, wherein said first color is identical to said second color.

4. The adjustable cabinet leg recited in claim 2, wherein said first color is of a first hue and said second color is of a second hue, wherein said first hue is different than said second hue.

5. The adjustable cabinet leg recited in claim 1, wherein said generally frustoconical outer surface comprises a lower frustoconical outer surface and an upper cylindrical outer surface.

6. The adjustable cabinet leg recited in claim 1, wherein said socket is a hex socket.

7. The adjustable cabinet leg recited in claim 1 further comprising a surface cap removably secured to said raised annular protrusion of said adjustable cabinet leg.

8. An adjustable cabinet leg kit, comprising:

said adjustable cabinet leg recited in claim 1; and, a drilling jig having a substantially annular body having an outer diameter and an inner diameter forming an inner aperture.

9. The adjustable cabinet leg kit recited in claim 8, wherein said drilling jig further comprises a raised annular protrusion circumscribing said inner aperture.

10. The adjustable cabinet leg kit recited in claim 9, wherein said drilling jig further comprises a bushing arranged within said inner aperture.

11. The adjustable cabinet leg kit recited in claim 8 further comprising a surface cap.

12. The adjustable cabinet leg kit recited in claim 8 further comprising a hex bit, said hex bit having a length that ensures said set screw remains in contact with said partially threaded through-bore when said hex bit is fully inserted into said partially threaded through-bore.

13. A method for leveling a cabinet using an adjustable cabinet leg, said cabinet leg comprising a body having a generally frustoconical outer surface of a color, said body having a longitudinal axis, said body further having a partially threaded through-bore arranged along said axis, said body having an annular bottom surface having an inside diameter and an outside diameter and an annular top surface having an inside diameter and an outside diameter, wherein said threads of said partially threaded through-bore are located proximate said bottom surface; an adhesive pad affixed to said top surface, said adhesive pad having a release liner; a raised annular protrusion having an inside diameter and an outside diameter extending upwardly from said top surface, said inside diameter of said annular protrusion arranged concentrically about said annular top surface inside diameter; and a set screw having a drive, a tip and a threaded shank arranged to engage said threads of said partially threaded through-bore, said set screw having a socket within said shank proximate said drive, said set screw further having a semi-spherical end cap having an outer surface of a color, said end cap further having an annular top surface having an inside diameter and an outside diameter, said inside diameter of said end cap annular top surface circumscribes said shank proximate said tip, said outside diameter of said end cap annular top surface is substantially equal to said outside diameter of said bottom surface of said body, said end cap made of a different material than said set screw, said end cap secured to said tip of said set screw, said cabinet having a floor, the method comprising:

drilling a plurality of holes in said cabinet floor;

peeling away said release liner of said adjustable cabinet leg;

securing at least three said adjustable cabinet legs to said cabinet floor by inserting said raised annular protrusion of each said leg inside of each of said plurality of holes in said cabinet floor; and, adjusting each said adjustable cabinet leg with a tool inserted into each said socket to level said cabinet.

* * * * *